US008317178B2

(12) United States Patent
Iida et al.

(10) Patent No.: US 8,317,178 B2
(45) Date of Patent: Nov. 27, 2012

(54) BOOKBINDING SYSTEM, BOOKBINDING CONTROL METHOD, AND RECORDING MEDIUM STORING BOOKBINDING CONTROL PROGRAM THAT PREVENTS SIMULTANEOUS RING BINDING WITH AN INCOMPATIBLE FOLD-TYPE

(75) Inventors: Junichi Iida, Kawasaki (JP); Takeshi Sasaki, Tokyo (JP); Satoshi Saito, Kawasaki (JP); Ikuhisa Okamoto, Sagamihara (JP); Shingo Matsushita, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 325 days.

(21) Appl. No.: 12/659,038

(22) Filed: Feb. 24, 2010

(65) Prior Publication Data

US 2010/0226733 A1 Sep. 9, 2010

(30) Foreign Application Priority Data

Mar. 3, 2009 (JP) ..... 2009-049687

(51) Int. Cl.
*B65H 37/04* (2006.01)
*B65H 37/06* (2006.01)

(52) U.S. Cl. ..... 270/37; 270/32; 399/410; 493/384

(58) Field of Classification Search ..... 270/32, 270/37; 493/351, 384, 392; 399/407, 410
See application file for complete search history.

(56) References Cited

U.S. PATENT DOCUMENTS

| | | | | |
|---|---|---|---|---|
| 5,905,935 | A * | 5/1999 | Wakamatsu et al. | 399/407 |
| 6,409,447 | B2 * | 6/2002 | Malmros | 412/40 |
| 7,410,158 | B2 | 8/2008 | Iida et al. | |
| 2005/0265809 | A1 * | 12/2005 | Lemens et al. | 412/33 |
| 2005/0271400 | A1 * | 12/2005 | Okamoto et al. | 399/21 |
| 2005/0281572 | A1 * | 12/2005 | Kawakami et al. | 399/49 |
| 2006/0038336 | A1 * | 2/2006 | Hirata et al. | 270/37 |
| 2007/0147922 | A1 | 6/2007 | Iida et al. | |
| 2008/0008491 | A1 * | 1/2008 | Tao et al. | 399/82 |
| 2008/0075560 | A1 * | 3/2008 | Kurabayashi et al. | 412/38 |
| 2009/0252545 | A1 * | 10/2009 | Sasaki | 399/410 |
| 2009/0257846 | A1 * | 10/2009 | Matsushita et al. | 412/6 |
| 2009/0269167 | A1 | 10/2009 | Iida et al. | |

FOREIGN PATENT DOCUMENTS

| | | |
|---|---|---|
| JP | 63-231988 | 9/1988 |
| JP | 07-069525 | 3/1995 |
| JP | 09-240915 | 9/1997 |
| JP | 11-301919 | 11/1999 |
| JP | 2001-260564 | 9/2001 |

(Continued)

*Primary Examiner* — Patrick Mackey
(74) *Attorney, Agent, or Firm* — Harness, Dickey & Pierce, P.L.C.

(57) ABSTRACT

A bookbinding system includes an image forming apparatus, a plurality of post-processing apparatuses, a controller, and an operation-and-display unit. The image forming apparatus forms images on recording media and outputs the recording media. The plurality of post-processing apparatuses is connected to the image forming apparatus and includes at least a folding apparatus and a ring-binding apparatus. The folding apparatus folds the recording media according to a plurality of folding types including at least Z-shape folding and double folding. The ring-binding apparatus binds the recording media with a ring. The controller is communicatively connected to the image forming apparatus and the plurality of post-processing apparatuses and prevents simultaneous selection of ring binding and a folding type incompatible with ring binding. The operation-and-display unit displays an indication that ring binding and the folding type incompatible with ring binding are not simultaneously selectable.

9 Claims, 9 Drawing Sheets

FOREIGN PATENT DOCUMENTS

| | | |
|---|---|---|
| JP | 2002-128385 | 5/2002 |
| JP | 2003-054154 | 2/2003 |
| JP | 2006-117383 | 5/2006 |
| JP | 2006-151592 | 6/2006 |
| JP | 2007-030319 | 2/2007 |
| JP | 2007-031068 | 2/2007 |
| JP | 2007-055179 | 3/2007 |
| JP | 2007-237562 | 9/2007 |

* cited by examiner

BOOKBINDING SYSTEM, BOOKBINDING CONTROL METHOD, AND RECORDING MEDIUM STORING BOOKBINDING CONTROL PROGRAM THAT PREVENTS SIMULTANEOUS RING BINDING WITH AN INCOMPATIBLE FOLD-TYPE

CROSS-REFERENCE TO RELATED APPLICATIONS

The present patent application claims priority pursuant to 35 U.S.C. §119 from Japanese Patent Application No. 2009-049687, filed on Mar. 3, 2009 in the Japan Patent Office, which is incorporated herein by reference in its entirety.

BACKGROUND OF THE INVENTION

1. Field of the Invention

Illustrative embodiments of the present invention relate to a bookbinding system that automatically performs post processing, such as ring-binding and folding, on sheet-type recording media (hereinafter, "sheet") to bind a book in connection with an image forming apparatus such as a copier, a printer, a facsimile, or a digital multi-functional peripheral having two or more of the foregoing capabilities, a method of controlling bookbinding in the book binding system, and a recording medium storing bookbinding program codes that cause an information processing apparatus to execute the method of controlling bookbinding.

2. Description of the Background

There are systems proposed in which a post-processing apparatus or a bookbinding apparatus is connected to an image forming apparatus.

In one conventional technique like that described in Japanese Patent Application Laid-open No. 2002-128385, a sheet processing apparatus is integrally or separately provided with the image forming apparatus. The sheet processing apparatus includes a punching unit that punches sheets sent from the image forming apparatus according to a plurality of punch types, such as two-hole punching and three-hole punching. The sheet processing apparatus also includes a display unit that displays executable punch types and, when executing one of the executable punch types, changes display contents depending on the executed punch type. Thus, a plurality of different punch types can be selected, improving convenience for users.

In another conventional technique like that described in Japanese Patent Application Laid-Open No. 2003-054154, a post-processing apparatus includes a stapling device that receives a plurality of transfer sheets from the image forming apparatus, stacks the transfer sheets on a staple tray, and staples the transfer sheets stacked on the staple tray. A stapler cartridge is detachably mountable in the stapling device and holds staples of a certain size. Depending on the number or thickness of transfer sheets to be stapled, staples of an optimum size are installed in the stapler cartridge and the stapler cartridge is then mounted in the stapling device to perform stapling. Such a configuration allows stapling of sheets with excellent finishing without complicating the apparatus configuration, upsizing due to an increased number of components, and cost increase.

Still another conventional technique like that described in Japanese Patent Application Laid-Open No. 2006-117383 is proposed in which a sheet post-processing apparatus performs a plurality of types of folding, such as Z-shape folding, two folding, four folding, and double-door folding, on a sheet conveyed from the previous stage and output the folded sheet to the subsequent stage.

Recently, much interest has been focused on a sheet processing system in which several different types of apparatuses, such as a ring-binding apparatus, a punching apparatus, and a stapling apparatus, are linearly (serially) connected to the image forming apparatus. The sheet processing system forms images on a plurality of sheets, performs a plurality of types of processing, such as bookbinding, punching, and stapling on the sheets, and outputs the processed sheets or sheet bundle. For example, in such an image forming system, after a folding apparatus folds sheets, a ring binding apparatus punches the folded sheets and binds the punched sheets with a ring. There is much demand from users to increase the number of folding types and enhance folding productivity. However, the availability of bookbinding to be subsequently performed may vary depending on the type of folding previously performed on the sheets.

It may be difficult for a user to recognize whether or not bookbinding is possible for a given type of folding, thus requiring the user to previously find the relation between bookbinding and folding type by referring to documentation of some sort, e.g., a user's guide. Consequently, for example, when the sheets are folded and bound with a ring, the open side of the sheets may be falsely punched and bound with the ring(s). In such a case, the user needs to redo the bookbinding process from the beginning starting with the printing, thus reducing work efficiency and wasting printed sheets.

Thus, in the above-described image forming system, when folding is performed in response to a request from a user, the subsequently executable bookbinding type is limited depending on the folding type. However, the user has no simple way to recognize the contours of such a limitation, and thus there is much demand for a more convenient, user-friendly system.

SUMMARY OF THE INVENTION

In one illustrative embodiment, a bookbinding system includes an image forming apparatus, a plurality of post-processing apparatuses, a controller, and an operation-and-display unit. The image forming apparatus forms images on recording media and outputs the recording media. The plurality of post-processing apparatuses is connected to the image forming apparatus and includes at least a folding apparatus and a ring-binding apparatus. The folding apparatus folds the recording media according to a plurality of folding types including at least Z-shape folding and double folding. The ring-binding apparatus binds the recording media with a ring. The controller is communicatively connected to the image forming apparatus and the plurality of post-processing apparatuses and prevents simultaneous selection of ring binding and a folding type incompatible with ring binding. The operation-and-display unit displays an indication that ring binding and the folding type incompatible with ring binding are not simultaneously selectable.

In another illustrative embodiment, a method of controlling bookbinding in a bookbinding system in which an image forming apparatus that forms images on recording media and outputs the recording media is connected with a plurality of post-processing apparatuses including at least a folding apparatus that folds the recording media according to a plurality of folding types including at least Z-shape folding and double folding and a ring-binding apparatus that binds the plurality of recording media with a ring. The method includes providing ring binding and the plurality of folding types in a selectable manner, preventing simultaneous selection of ring binding and a folding type incompatible with ring binding, and displaying on an operation-and-display unit an indication that ring binding and the folding type incompatible with ring binding are not simultaneously selectable.

In still another illustrative embodiment, a storage medium stores program codes that cause a bookbinding system to execute a method of controlling bookbinding. The bookbinding system includes an image forming apparatus that forms images on recording media and outputs the recording media and a plurality of post-processing apparatuses connected to the image forming apparatus. The plurality of post-processing apparatuses includes at least a folding apparatus that folds the recording media according to a plurality of folding types including at least Z-shape folding and double folding and a ring-binding apparatus that binds the recording media with a ring. The method includes providing ring binding and the plurality of folding types in a selectable manner, preventing simultaneous selection of ring binding and a folding type incompatible with ring binding, and displaying on an operation-and-display unit an indication that ring binding and the folding type incompatible with ring binding are not simultaneously selectable.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
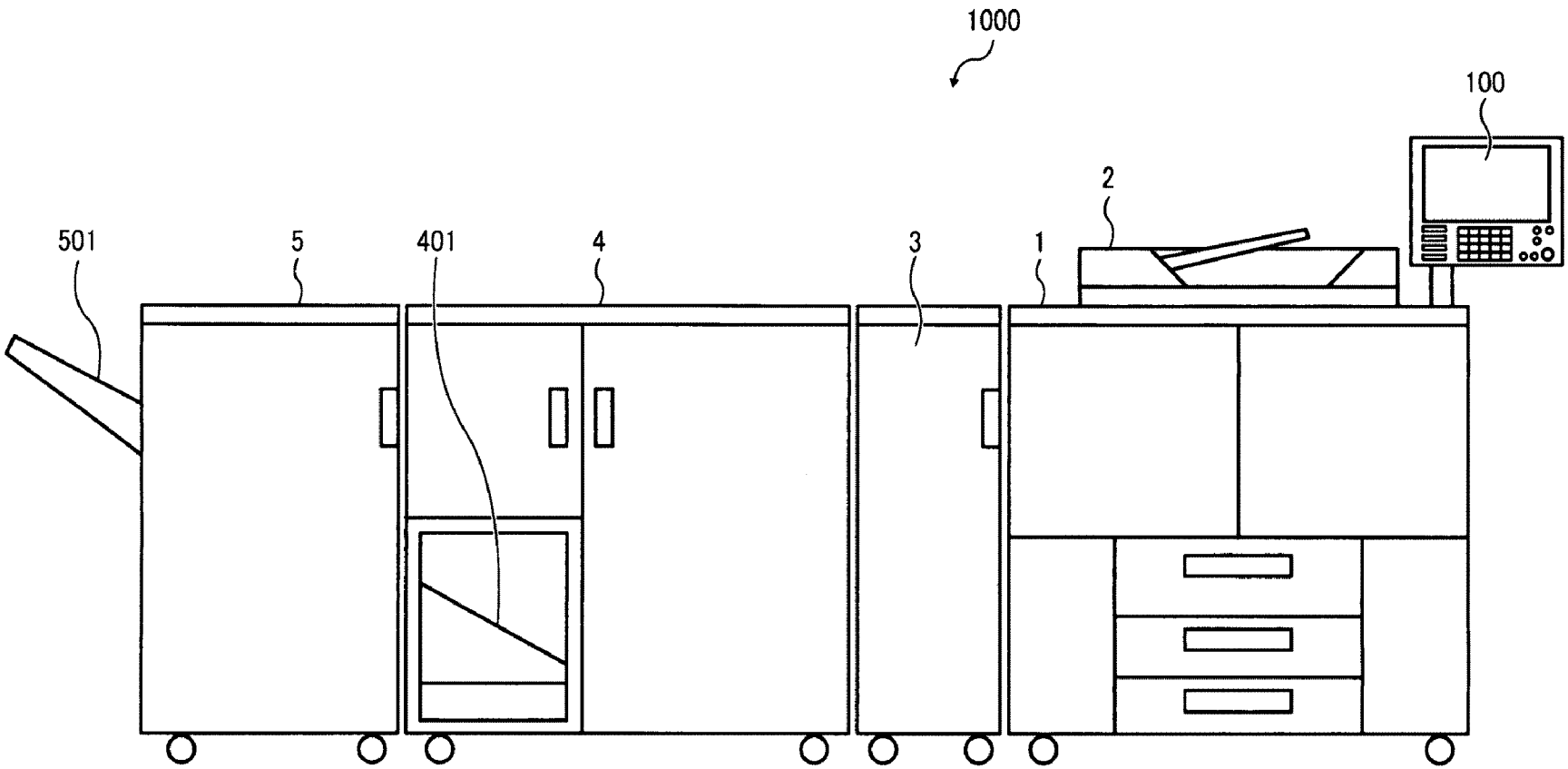
FIG. 1 is a plan view illustrating a configuration of a bookbinding system (image formation system) according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

FIG. 1 is a plan view illustrating a configuration of a bookbinding system (image formation system) 1000 according to an illustrative embodiment of the present disclosure. The configuration of the bookbinding system 1000 is described below.

In the present illustrative embodiment, an image forming apparatus is described as an MFP 1. The MFP 1 has an ADF (auto document feeder) 2 and an operation panel (operation unit) 100 with a display unit. A folding apparatus 3 is connected to the downstream side in the sheet output direction of the MFP 1. Further, a ring-binding apparatus 4 and a finishing apparatus (finisher) 5 are connected to the downstream side of the folding apparatus 3. The folding apparatus 3 performs a plurality of types of folding, such as two folding, triple folding, Z-shape folding, four folding, and gate folding. The folding apparatus 3 folds a sheet on which an image has been formed in the MFP 1 according to a desired folding type and feeds the sheet to the ring-binding apparatus 4. Alternatively, the folding apparatus 3 bypasses folding processing and feeds a sheet on which an image has been formed in the MFP 1 to the finishing apparatus 5. The ring-binding apparatus 4 binds folded sheets with a ring(s) and outputs the bound sheets to a stack tray (ring-binding output tray) 401. The finishing apparatus 5 performs a certain type of finishing on the bound sheets to output them to an exterior output tray 501.

Figure 2:
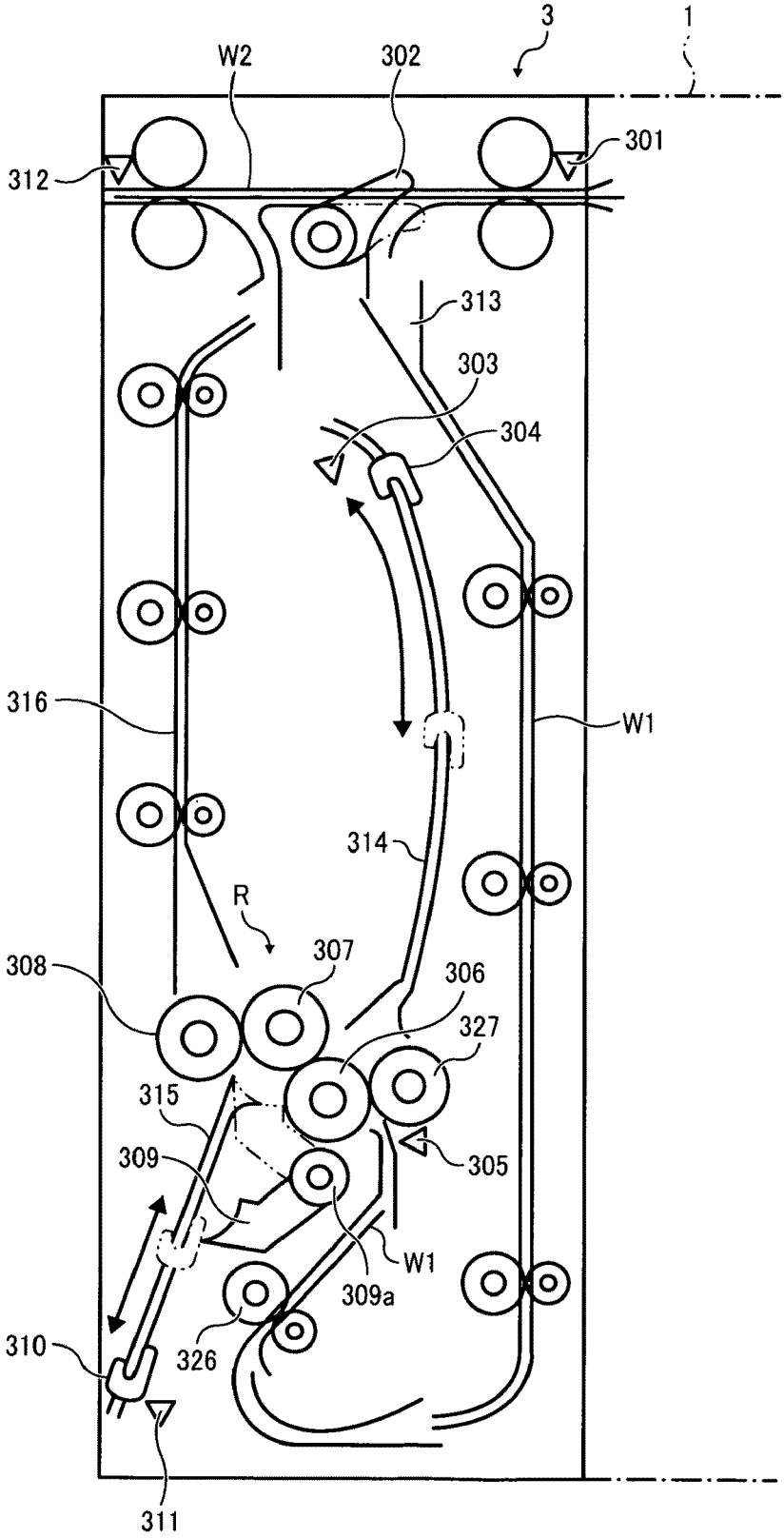
FIG. 2 is a schematic view illustrating a configuration of a folding apparatus.

FIG. 2 is a schematic view illustrating a configuration of the folding apparatus 3.

In FIG. 2, when the sheet on which an image is formed in the MFP 1 is fed to the subsequent stage, the sheet is fed from an entry into the folding apparatus 3 and detected with an entry sensor 301. At the downstream side of the entry sensor 301 is disposed a switching claw 302 that is driven by a solenoid not illustrated. When the solenoid is turned on, the switching claw 302 retreats to a first position indicated by a dotted line in FIG. 2 so that the sheet is linearly fed. On the contrary, when the solenoid is turned off, the switching claw 302 pivots to a second position indicated by a solid line in FIG. 2 so that the sheet is fed to a folding unit "R". A feed path from the entry provided with the entry sensor 301 is branched into two paths, that is, an introduction path W1 through which the sheet is fed into the folding unit R and an output path W2 through which the sheet is output to the subsequent stage. One end of the introduction path W1 is connected to the folding unit R. In the folding unit R, a first feed path 314 is disposed above a group of rollers described below. Separately from the first feed path 314, a second feed path 315 is disposed at the lower left of the group of rollers. Further, a third feed path 316 serving as an output route is disposed at the upper left of the group of rollers so as to connect the group of rollers and the output path W2.

The first feed path 314 is provided with a first guide plate (first stopper) 304 movable between a first position indicated by a solid line and a second position indicated by a dotted line in FIG. 2 along the first feed path 314. The second feed path 315 is provided with a second guide plate (second stopper) 310 movable between a first position indicated by a solid line and a second position indicated by a dotted line in FIG. 2 along the second feed path 315. A first home-position sensor 303 and a second home-position sensor 311 are disposed at the first feed path 314 and the second feed path 315. The group of rollers described above includes a first folding roller 306, a second folding roller 307 that forms a nip between it and the first folding roller 306, a driven roller 327 that forms a nip between it and the first folding roller 306, and a third folding roller 308 that forms a nip between it and the second folding roller 307. A folding switching claw 309 is disposed so as to pivot around a shaft 309*a* thereof between a first position indicated by a solid line and a second position indicated by a dotted line in FIG. 2.

The moving of the first guide plate 304 is controlled using, e.g., a PM (permanent magnet) motor which is not illustrated. An electromagnetic clutch, not illustrated, is mounted on the first folding roller 306. When the electromagnetic clutch is turned on, the first folding roller 306 starts rotating. On the contrary, when the electromagnetic clutch is turned off, a shaft of the first folding roller 306 runs idle. The folding switching claw 309 is controlled by a solenoid, not illustrated, so as to pivot between the first (solid-line) position and the second (dotted-line) position. When the solenoid is turned on, the folding switching claw 309 moves to the second (dotted-line) position to block the second feed path 315. On the contrary, when the solenoid is turned off, the folding switching claw 309 moves to the first (solid-line) position so that the sheet is fed to the second feed path 315. The second guide plate 310 is controlled using, e.g., a PM motor, which is not illustrated. The first folding roller 306, the second folding roller 307, the third folding roller 308, a feed roller 326, and other rollers are driven using, e.g., a brushless motor, which is not illustrated.

When the folding apparatus 3 does not fold the sheet fed from the MFP 1, the switching claw 302 retreats to the first (dotted-line) position in FIG. 2 so that the sheet is linearly fed to the ring-binding apparatus 4. Alternatively, when execution of folding is selected by an input operation from the operation panel 100 of the MFP 1, the sheet is guided with the switching claw 302 into an inlet portion 313 and fed through the introduction path W1. When a front end of the sheet, not illustrated, arrives at a registration sensor 305 disposed near the nip between the first folding roller 306 and the driven roller 327, the PM motor is excited so that, when the sheet is further fed to the downstream side in the sheet feed direction and contacts against the first guide plate 304 and the second guide plate 310, the first guide plate 304 and the second guide plate 310 are not moved by the contact. In a time period of Tm seconds from when the front end of the sheet arrives at the registration sensor 305 until the clutch of the first folding roller 306 is turned on, skew correction is performed on the sheet with the front end of the sheet held at the nip between the first folding roller 306 and the driven roller 327 in a stopped state. After the skew correction, the sheet is fed into the first feed path 314.

After the front end of the sheet fed to the first feed path 314 is butted against the first guide plate 304 stopped at a predetermined position, the sheet starts to bend at the nip between the first folding roller 306 and the second folding roller 307. As the sheet further goes bending, a middle portion of the sheet is sandwiched at the nip between the first folding roller 306 and the second folding roller 307. At this time, when two folding is selected, the folding switching claw 309 is at ON state (at the dotted-line position). Accordingly, the sheet is directly fed to the nip between the second folding roller 307 and the third folding roller 308 and ejected from the third feed path 316.

When a folding type other than two folding (three or more folding) is selected, the folding switching claw 309 is at the solid-line position. Accordingly, the middle portion of the sheet passes through the nip between the first folding roller 306 and the second folding roller 307 and is fed to the second feed path 315. When the middle portion of the sheet is butted against the second guide plate 310, another portion of the sheet starts to bend near the nip between the second folding roller 307 and the third folding roller 308, sandwiched at the nip between the second folding roller 307 and the third folding roller 308, and fed to the third feed path 316. The sheet is fed from the third feed path 316 to a sheet output section and outputted to a subsequent stage. The status of sheet output from the folding apparatus 3 is determined by detecting the rear end of the sheet with the sheet-output sensor 312 disposed near a sheet outlet of the output path W2.

Figure 3:
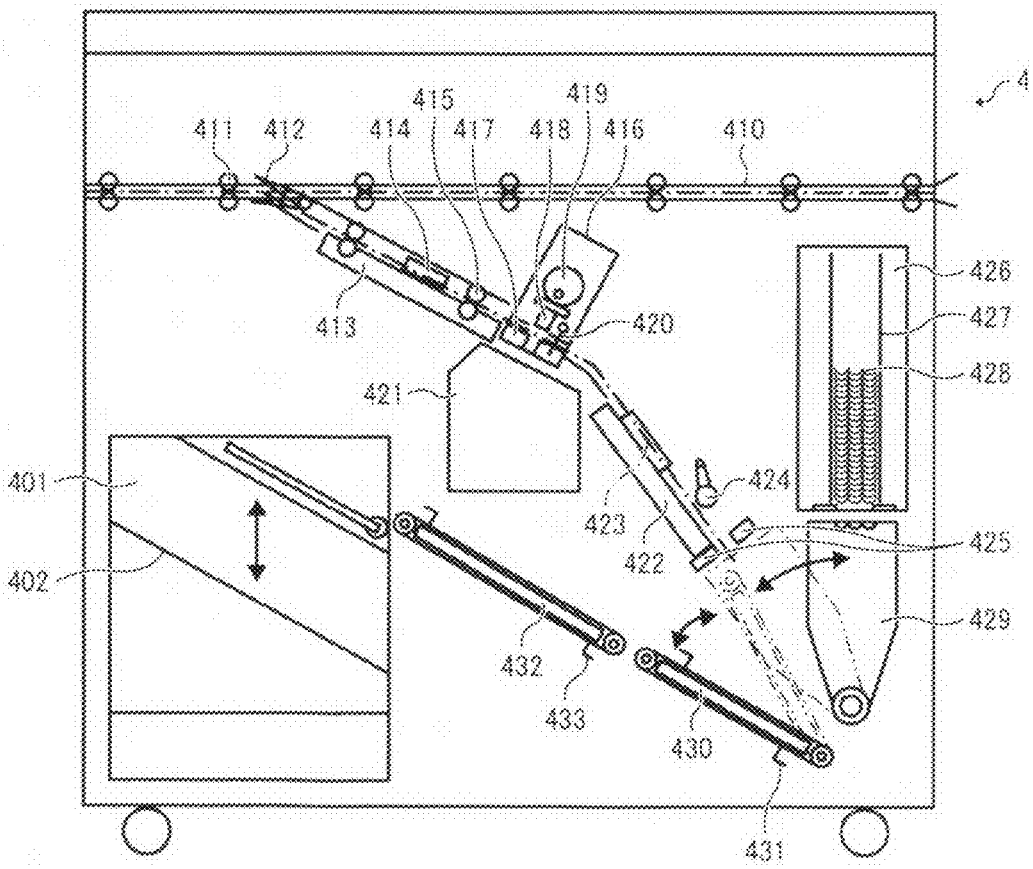
FIG. 3 is a schematic view illustrating a configuration of a ring-binding apparatus.

FIG. 3 is a schematic view illustrating a configuration of the ring-binding apparatus 4 jointed to the folding apparatus 3. Below, the mechanism, operation, and function of the ring-binding apparatus 4 are described.

The ring-binding apparatus 4 includes a lateral feed path 410, a first alignment tray 413, a second alignment tray 422, a bundle feeder 430, a finished bundle feeder 432, a stack tray 401, a clamp 425 storing rings, and a ring-binding unit 429. A sheet fed from the MFP 1 through the folding apparatus 3 is fed to the lateral feed path 410. When the sheet is not bound with a ring, the sheet is laterally fed to the finishing apparatus 5 disposed at the downstream side of the sheet feed direction. Alternatively, when the sheet is bound with a ring, the sheet is switched back using reverse rollers 411 disposed at a downstream portion of the lateral feed path 410. At this time, a switching member 412 is shifted to feed the sheet to a punching section that is disposed obliquely below the switching member 412.

In the punching section, a jogger 414 contacts edges of the sheet on the first alignment tray 413 from a direction substantially perpendicular to the sheet feed direction to align the edges of the sheet with respect to a direction (hereinafter "lateral direction" of the sheet) parallel to the sheet feed direction. On the other hand, a front end of the sheet in the sheet feed direction is butted against a front-end stopper 420 protruding to the sheet feed path of the first alignment tray 413. Accordingly, the front end of the sheet is aligned with respect to the sheet feed direction (hereinafter "long direction" of the sheet). Thus, with the first alignment tray 413 and the front-end stopper 420, the sheet is positioned in the lateral and long directions. When the sheet is butted against the front-end stopper 420, feed rollers 415 with a torque limiter give a feed force to the sheet so as to prevent damage of the front end of the sheet.

When the sheet is positioned, a cam 419 of a punching unit 416 starts rotating to push a punch 418 down, so that the sheet is punched with the punch 418 and a die 417. The punching unit 416 punches multiple holes for ring binding. When the punching is finished, the front-end stopper 420 retreats from the sheet feed path. As a result, the contact state of the sheet with the front-end stopper 420 is released and the sheet is fed further downstream in the sheet feed direction. Punched pieces are received in a punched-piece container 421.

The sheet is fed to an alignment section. In the alignment section, multiple sheets for bookbinding are received, aligned, and stacked sheet by sheet at the second alignment tray 422. The alignment tray 422 includes a lateral alignment jogger 423 and a tap roller 424 to tap a sheet in the sheet feed direction. On the alignment tray 422, the positions of multiple sheets are aligned with a fence, not illustrated, with respect to the feed direction (long direction) of the sheets and with the lateral alignment jogger 423 with respect to the lateral direction of the sheets.

When a desired number of sheets is stacked and aligned on the second alignment tray 422, a bound side of the sheet stack is pressingly held using the clamp 425. Near the second alignment tray 422 is disposed a ring cartridge holder 426 that houses a ring cartridge 427. A large number of rings 428 is stacked in the ring cartridge 427. In FIG. 3, a circular plastic ring having three segmented pieces is illustrated as an example of the rings 428.

When a desired number of sheets to be bound is stacked and aligned on the second alignment tray 422, the ring-binding unit 429 is pivotally moved to a position below the ring cartridge 427 to take one of the rings 428. Taking the ring 428, the ring-binding unit 429 is pivotally moved to a position below the clamp 425 while holding the ring 428 to pass the ring 428 into a hole punched at a lower end of the bundle of sheets. A binding unit, not illustrated, binds the bundle of sheets with the ring 428. When the bundle feeder 430 is pivotally moved to a position below the clamp 425, the clamp 425 is detached from the sheet bundle bound with a ring. As a result, the sheet bundle is received by a discharge hook 431 provided at a belt of the bundle feeder 430 and transferred on the bundle feeder 430.

The bundle feeder 430 pivots counter-clockwise to a position at which the bundle feeder 430 forms a substantially linear line with the finished bundle feeder 432. The sheet bundle is transferred to the finished bundle feeder 432 using the discharge hook 431 of the belt of the bundle feeder 430. From the finished bundle feeder 432, the sheet bundle is discharged to the stack tray 401 using a discharge hook 433 provided at a belt of the finished bundle feeder 432. The stack tray 401 moves up and down in response to the sheet stack amount. For example, as illustrated in FIG. 3, the stack tray 401 moves down to a lowest position 402. As described above, a series of bookbinding processes is performed.

In this regard, when a previously punched sheet is used, a sensor may be provided on, for example, the lateral feed path 410 to detect a punched hole. In the present illustrative embodiment, a reflective sensor detects a punch hole at the switchback section at which the sheet is stopped and determines the presence/absence of the punch hole based on results of the detection.

Figure 4:
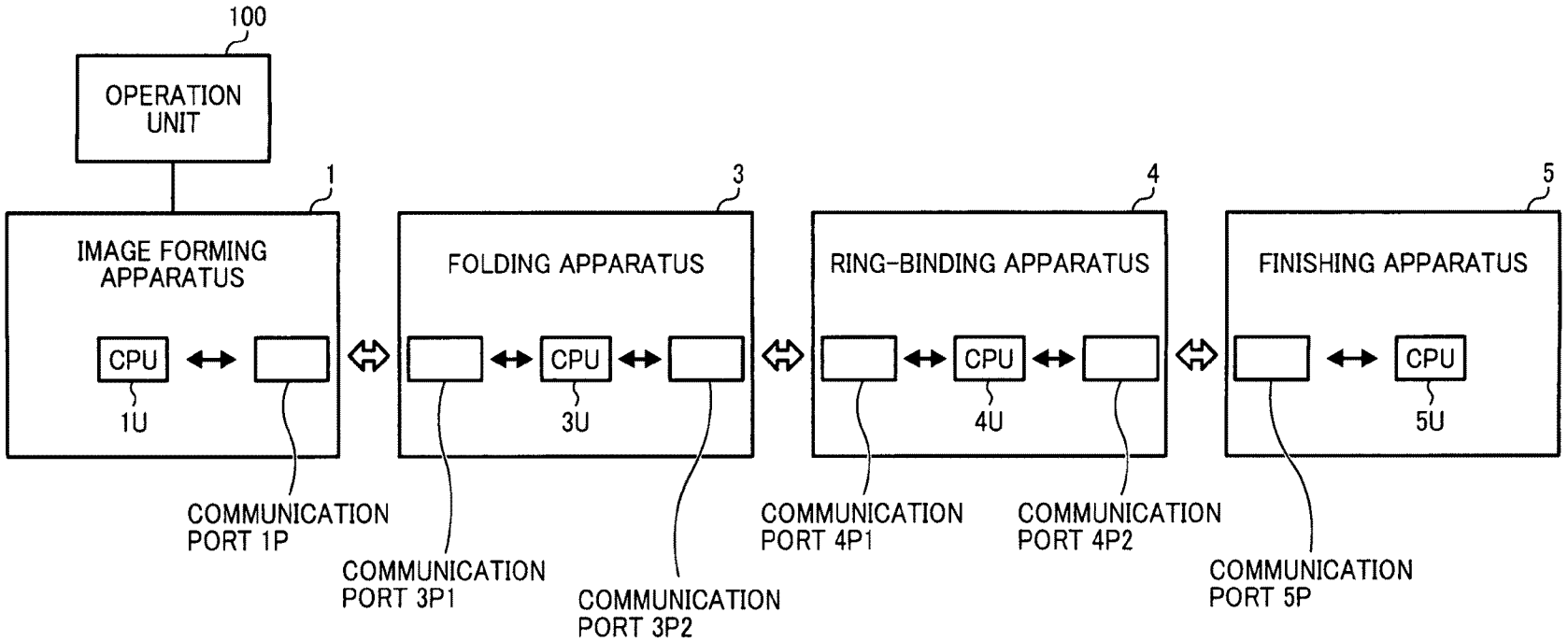
FIG. 4 is a block diagram illustrating a schematic configuration of online control of the bookbinding system illustrated in FIG. 1.

FIG. 4 is a block diagram illustrating a configuration of online control of the bookbinding system 1000 illustrated in FIG. 1. In the online bookbinding system 1000, the MFP (image forming apparatus) 1 is connected with the folding apparatus 3, which is connected with the ring-binding apparatus 4. Further, the ring-binding apparatus 4 is connected with the finishing apparatus 5. In FIG. 4, the MFP 1 includes a CPU 1U and a communication port 1P. The folding apparatus 3 includes a CPU 3U and communication ports 3P1 and 3P2. The ring-binding apparatus 4 includes a CPU 4U communication ports 4P1 and 4P2. The finishing apparatus 5 includes a CPU 5U and a communication port 5P. The MFP 1 and the folding apparatus 3 communicate with each other via the communication ports 1P and 3P1. The folding apparatus 3 and the ring-binding apparatus 4 communicate with each other via the communication ports 3P2 and 4P1. The ring-binding apparatus 4 and the finishing apparatus 5 communicate with each other via the communication ports 4P2 and 5P. The operation panel 100 is connected to an interface (I/F), not illustrated, of the MFP 1 and displays contents in accordance with a display instruction sent from the CPU 1U of the MFP 1 as described below. A user inputs an operation to the MFP 1 by key entry through the operation panel 100.

The CPUs 1U, 3U, 4U and 5U mounted on the MFP 1, the folding apparatus 3, the ring-binding apparatus 4, and the finishing apparatus 5 read program codes from respective ROMs of the MFP 1, the folding apparatus 3, the ring-binding apparatus 4, and the finishing apparatus 5 into RAMs, and execute processing according to the program codes while using the RAMs as working areas and data buffers. Thus, the following control and processing are performed.

The MFP 1, the folding apparatus 3, the ring-binding apparatus 4, and the finishing apparatus 5 are connected electrically serially via the communication ports 1P, 3P1, 3P2, 4P1, 4P2, and 5P and mechanically serially via at least the lateral feed path 410 so as to form a straight line. For example, on online processing, those apparatuses are electrically concurrently controlled.

In the bookbinding system 1000 including the folding apparatus 3 that performs the above-described plurality of types of folding, one folding type selected from the plurality of types of folding may be incompatible with ring-binding of the ring-binding apparatus 4. Hence, in the present illustrative embodiment, the relationship between display state and selection command of the operation panel 100, which is a man-machine interface, is defined to display compatible sets of folding type and ring binding so that a user can select a proper set of folding type and bookbinding from them.

Figure 5:
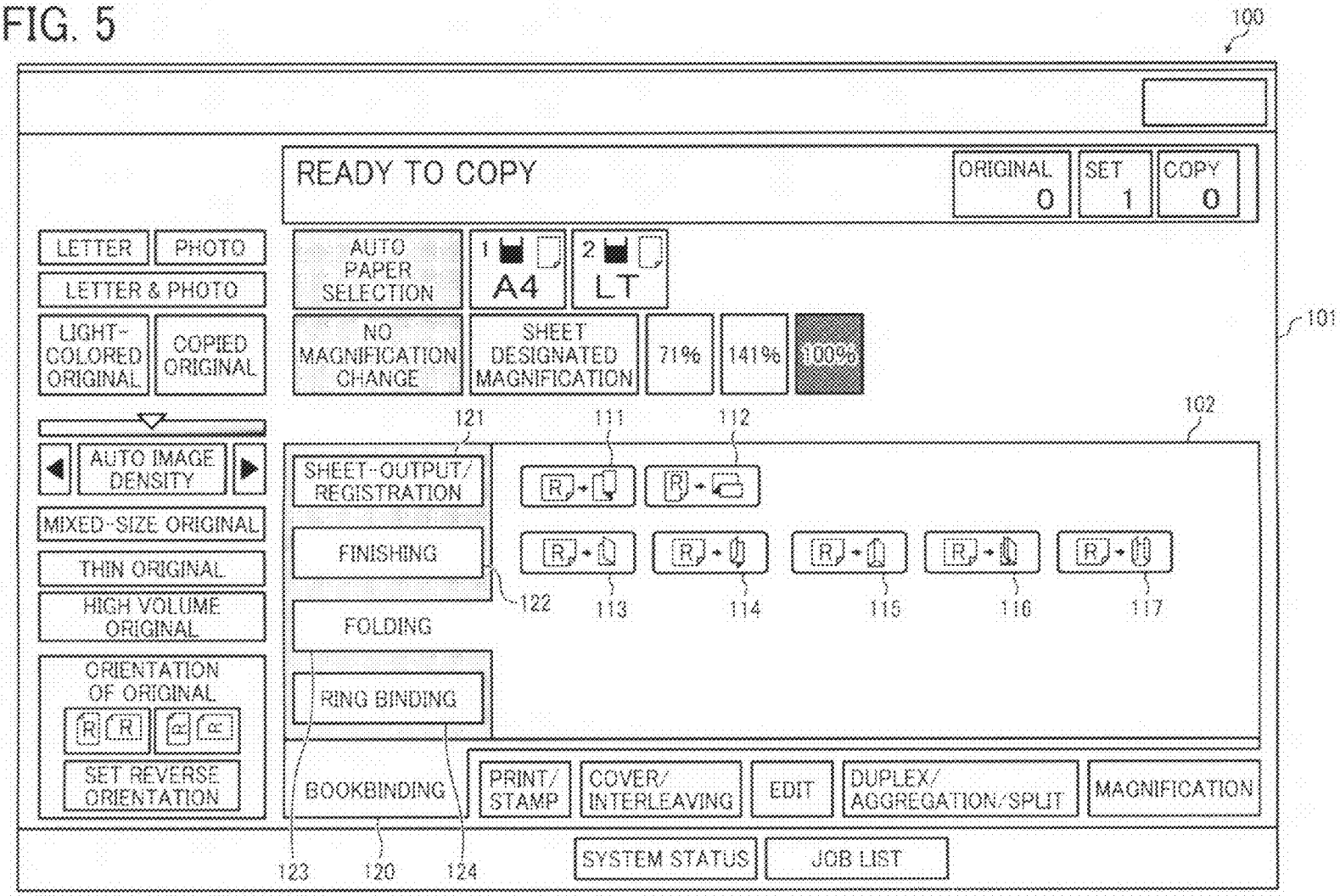
FIG. 5 is a front view illustrating an operation-and-display section of an operation panel that displays a selection screen of folding mode.

FIG. 5 is a front view illustrating an operation-and-display section 101 of the operation panel 100 that displays a selection screen of folding mode. In FIG. 5, a plurality of folding types executable in the folding apparatus 3 is displayed on a display area 102 of the operation-and-display section 101 so that a user can select a proper folding type. In FIG. 5, a horizontal Z-shape folding button 111, a vertical Z-shape folding button 112, a two-folding button 113, an outward three-folding button 114, an inward three folding button 115, a simple four folding button 116, and a four gate folding button 117 are displayed as examples of folding types. In the display area 102 are provided a sheet-output/registration button 121, a finishing button 122, a folding button 123, and a ring-binding button 124 as keys for selecting a sub layer of functions displayed after a bookbinding tab 120 is selected.

Figure 6:
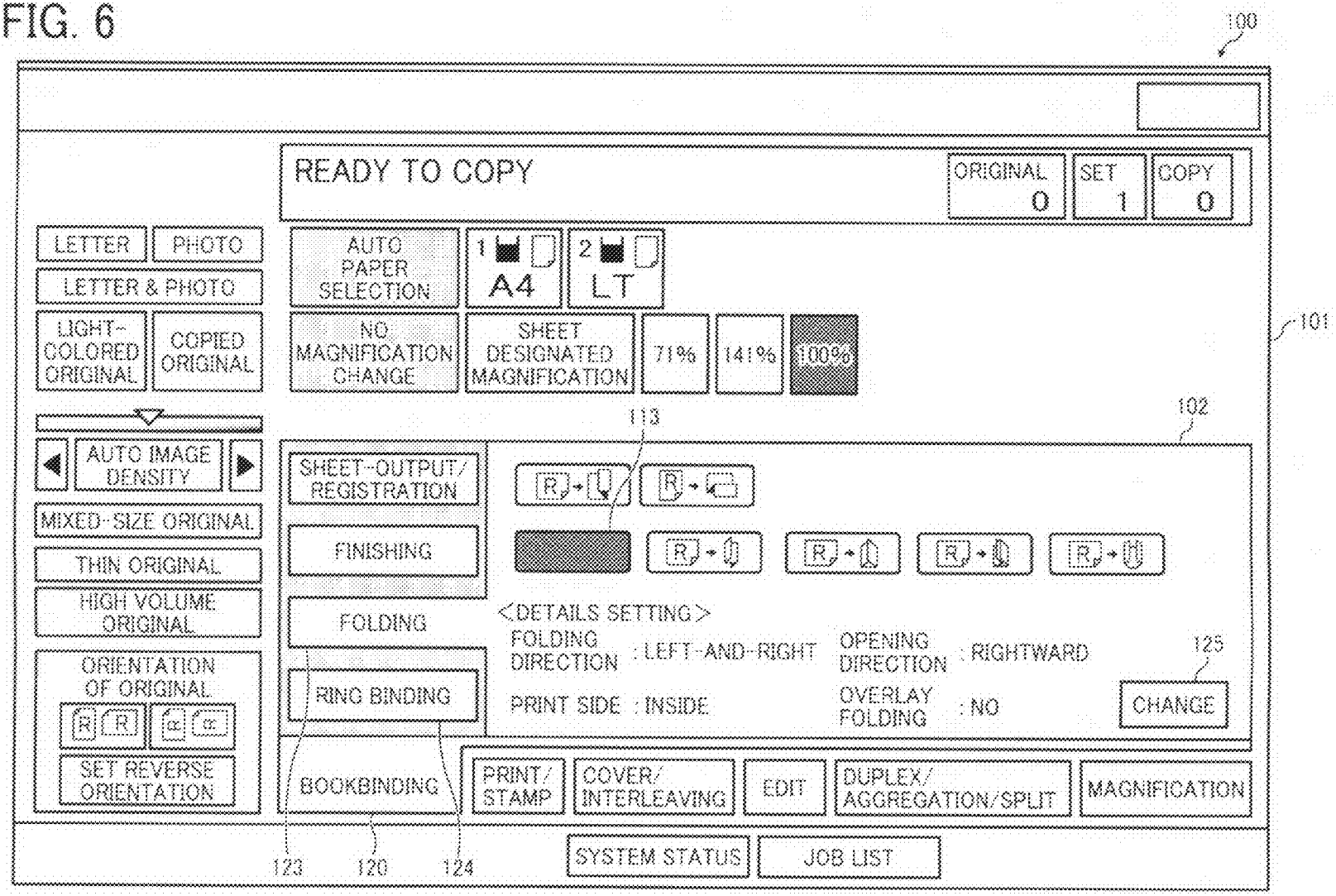
FIG. 6 is a diagram illustrating a screen for confirming setting contents on folding displayed when one folding mode is selected.

FIG. 6 is a diagram illustrating a screen for confirming setting contents on folding such as overlay folding available when one folding mode is selected. FIG. 6 shows a screen displayed when the two-folding button 113 is selected as the folding mode. When the two-folding button 113 is pressed, the operation-and-display section 101 displays the confirmation screen illustrated in FIG. 6. On the confirmation screen, details of the two folding are displayed in a setting detail sub-screen. As the setting detail sub-screen, setting items such as folding direction, opening direction, print side, and overlay folding, and a change button 125 are displayed. Thus, setting contents can be confirmed through the display of the setting detail sub-screen, and operation of the change button 125 allows a user to change setting contents.

Figure 7:
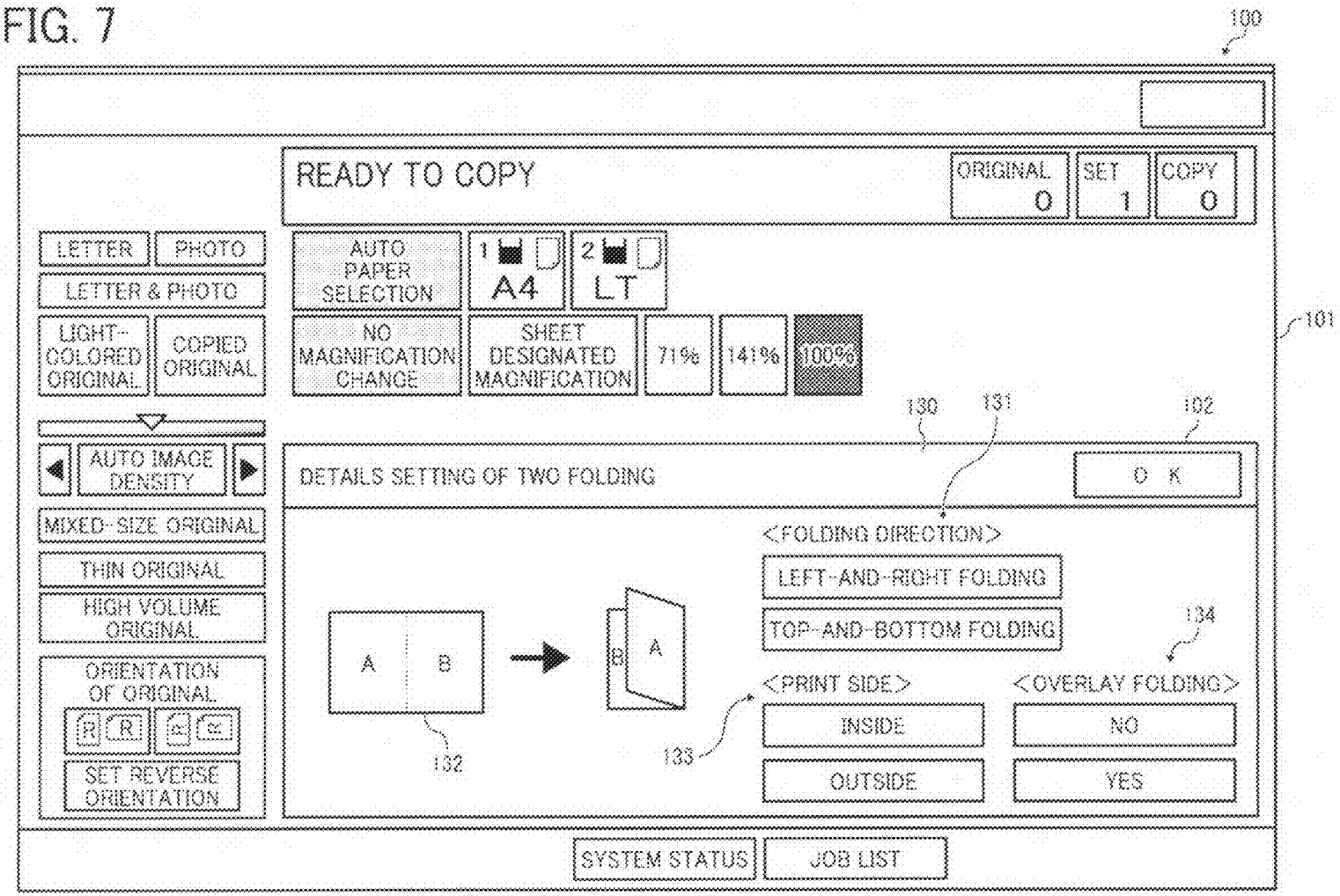
FIG. 7 is a diagram illustrating a sub screen for setting details of two folding after a change button is pressed on the confirmation screen illustrated in FIG. 6.

FIG. 7 is a diagram illustrating a sub screen 130 for setting details of two folding after the change button 125 is pressed. On the sub screen 130 are displayed a folding-direction selection button 131, an opening direction selection button 132, a print-side selection button 133, and an overlay-folding selection button 134, thus allowing a user to select setting changes through the sub screen 130. Highlighting setting contents allows a user to securely confirm effective settings.

Figure 8:
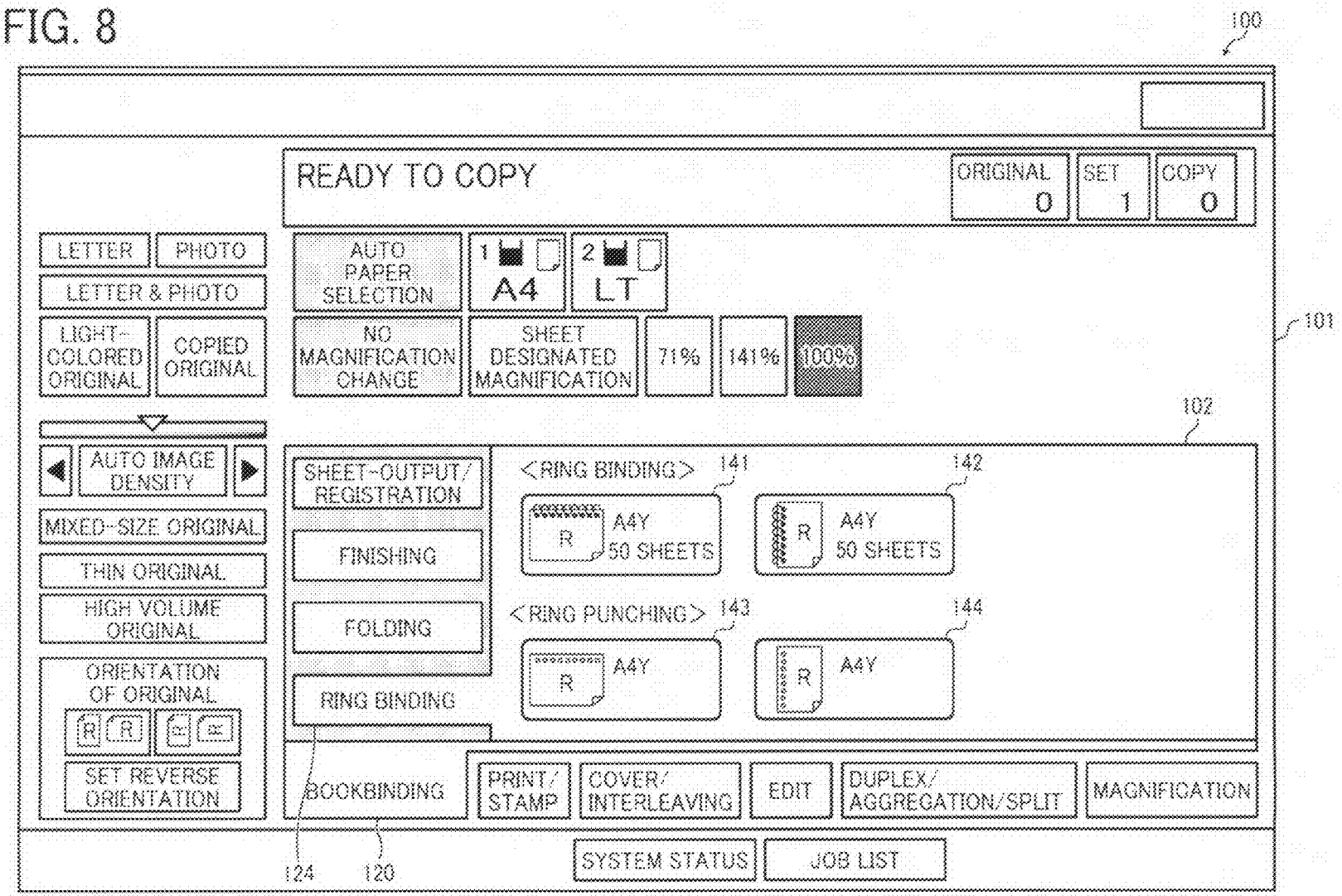
FIG. 8 is a diagram illustrating a function setting screen displayed when ring binding is selected.

In the present illustrative embodiment, when a folding mode other than Z-shape folding is selected, the screen shifts to a state in which ring binding and ring punching cannot be selected. For example, assumes that the two folding mode is selected as illustrated in FIG. 6. Here, it does not matter whether multi-sheet folding is selected or not, and in other words, multi-sheet folding may not be selected. In such a case, when the ring-binding button 124 is pressed as the subsequently selected function, the display of the display area 102 shifts to a function selection screen of ring binding. At this time, as illustrated in FIG. 8, ring-binding selection buttons 141 and 142 and ring-punch selection buttons 143 and 144 are displayed in gray as unselectable buttons. In the present illustrative embodiment, such buttons are displayed in gray to indicate unselectable state. However, it is to be noted that any other suitable display method may be employed if the unselectable state is clearly indicated. Alternatively, such unselectable buttons may not be displayed on the screen.

In the combination of folding and ring binding, only when Z-shape folding is selected, multi-sheet folding (overlay folding) becomes selectable. On the contrary, when Z-shape folding is selected, ring-binding mode and ring-punching mode becomes unselectable as with other folding modes. Alternatively, when ring-binding mode is selected by pressing the ring-binding button 124, selection buttons of other folding modes are displayed in gray with only Z-shape folding selectable, and multi-sheet folding of Z-shape folding also becomes unselectable. Such a method of indicating the unselectable state of the folding modes other than the Z-shape folding is not limited to displaying in gray, and any other suitable display method may be employed if functions are unselectable. Alternatively, an alert message indicating a reason why such functions are unselectable may be displayed on the operation-and-display section 101.

Figure 9:
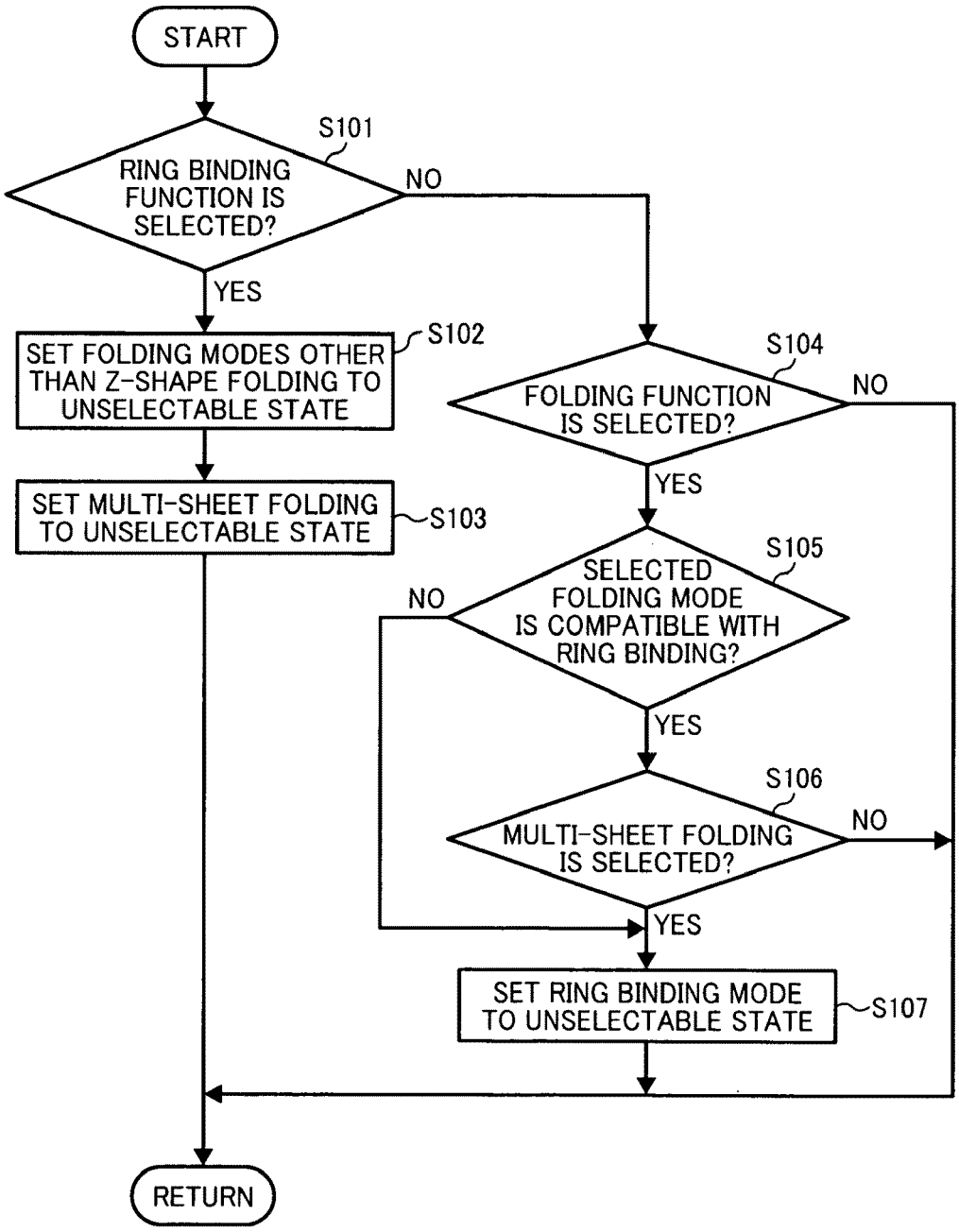
FIG. 9 is a flow chart illustrating a processing procedure performed when folding and ring binding are selected in the present illustrative embodiment.

FIG. 9 is a flow chart illustrating a processing procedure performed when folding and ring binding are selected in the present illustrative embodiment. In the procedure of FIG. 9, at S101 it is determined whether the ring-binding function of the ring-binding apparatus 4 is selected or not. If the ring-binding function of the ring-binding apparatus 4 is selected ("YES" at S101), at S102 other folding modes than Z-shape mode are set to the unselectable state since ring binding is performed. Further, at S103 multi-sheet folding is set to the unselectable state, and the process returns.

On the contrary, if the ring-binding function of the ring-binding apparatus 4 is not selected ("NO" at S101), at S104 it is determined whether folding function is selected or not. If folding function is not selected ("NO" at S104), at S105 it is determined whether or not a selected folding mode is selectable in combination with ring binding. If the selected folding mode is selectable in combination with ring binding, that is, Z-shape mode ("YES" at S105), at S106 it is further determined whether multi-sheet folding is selected or not. If multi-sheet folding is not selected ("NO" at S106), the process returns. On the contrary, if multi-sheet folding is selected ("YES" at S106), at S107 ring binding is set to the unselectable state and the process returns. Alternatively, if the selected folding mode is selectable in combination with ring binding ("NO" at S105), at S107 ring binding is set to the unselectable state and the process returns.

As described above, according to the present illustrative embodiment, when the MFP 1 is connected with the folding apparatus 3 and the ring-binding apparatus 4 to perform on-line bookbinding, the CPU 1U of the MFP 1 determines which function of folding and ring binding should be prioritized based on a selection order of folding mode and ring-binding function and which bookbinding and/or folding modes are available based on the selected mode or function. Accordingly, if a user selects only a desired folding type and a ring-binding function, the bookbinding system 1000 performs folding and bookbinding only when the selected folding type and ring-binding function are compatible with each other. Such a configuration allows execution of bookbinding without making a user conscious of the relation between folding and bookbinding, thus enhancing the workability, operability, and convenience of the bookbinding system 1000.

As described above, the present illustrative embodiment is applicable to an image forming system in which a folding apparatus, a ring-binding apparatus, and a finishing apparatus are connected to an image forming apparatus to perform a series of processing from printing to bookbinding and at least two processing, that is, folding and ring binding involving punching, are selectable.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A bookbinding system comprising:

an image forming apparatus that forms images on recording media and outputs the recording media;

a plurality of post-processing apparatuses connected to the image forming apparatus, the plurality of post-processing apparatuses comprising a folding apparatus that folds the recording media according to a plurality of folding types including at least Z-shape folding and double folding and a ring-binding apparatus that binds the recording media with a ring;

a controller communicatively connected to the image forming apparatus and the plurality of post-processing apparatuses, the controller preventing simultaneous selection of ring binding and a folding type incompatible with ring binding; and an operation-and-display unit that displays an indication that ring binding and the folding type incompatible with ring binding are not simultaneously selectable.

2. The bookbinding system according to claim 1, wherein the folding type incompatible with ring binding is a folding type other than Z-shape folding.

3. The bookbinding system according to claim 1, wherein the folding type incompatible with ring binding is multi-sheet folding in which multiple sheets are simultaneously folded.

4. The bookbinding system according to claim 1, wherein the operation-and-display unit displays the plurality of folding types and a plurality of ring-binding types to allow a user to select desired types of folding and ring binding, wherein the controller determines whether or not the desired types of folding and ring binding are simultaneously selectable in accordance with a selection inputted from the operation-and-display unit.

5. The bookbinding system according to claim 4, wherein when a selected folding type is incompatible with ring binding, the controller causes the operation-and-display unit to display an indication that ring binding is not executable.

6. The bookbinding system according to claim 4, wherein when ring binding is selected, the controller causes the operation-and-display to display folding types other than the Z-shape folding in an unselectable state.

7. The bookbinding system according to claim 6, wherein when the Z-shape folding is selected, the controller sets the multi-sheet folding to an unselectable state.

8. A method of controlling bookbinding in a bookbinding system in which an image forming apparatus that forms images on recording media and outputs the recording media is connected with a plurality of post-processing apparatuses comprising a folding apparatus that folds the recording media according to a plurality of folding types including at least Z-shape folding and double folding and a ring-binding apparatus that binds the plurality of recording media with a ring;

the method comprising:

providing ring binding and the plurality of folding types in a selectable manner;

preventing simultaneous selection of ring binding and a folding type incompatible with ring binding; and displaying on an operation-and-display unit an indication that ring binding and the folding type incompatible with ring binding are not simultaneously selectable.

9. A storage medium storing program codes that cause a bookbinding system to execute a method of controlling bookbinding, the bookbinding system comprising an image forming apparatus that forms images on recording media and outputs the recording media and a plurality of post-processing apparatuses connected to the image forming apparatus, the plurality of post-processing apparatuses comprising a folding apparatus that folds the recording media according to a plurality of folding types including at least Z-shape folding and double folding and a ring-binding apparatus that binds the recording media with a ring;

the method comprising:

providing ring binding and the plurality of folding types in a selectable manner;

preventing simultaneous selection of ring binding and a folding type incompatible with ring binding; and displaying on an operation-and-display unit an indication that ring binding and the folding type incompatible with ring binding are not simultaneously selectable.

* * * * *